US007396999B2

(12) United States Patent
Miller et al.

(10) Patent No.: US 7,396,999 B2
(45) Date of Patent: Jul. 8, 2008

(54) DEVICE FOR MANAGING TERMINATION OF CONDUCTORS WITH JACK MODULES

(75) Inventors: Timothy C. Miller, McKinney, TX (US); Troy J. Long, Omaha, NE (US); Danny L. Satterthwaite, Allen, TX (US)

(73) Assignee: CommScope Solutions Properties, LLC, Sparks, NV (US)

( * ) Notice: Subject to any disclaimer, the term of this patent is extended or adjusted under 35 U.S.C. 154(b) by 0 days.

(21) Appl. No.: 11/360,733

(22) Filed: Feb. 23, 2006

(65) Prior Publication Data

US 2007/0158097 A1 Jul. 12, 2007

Related U.S. Application Data

(60) Provisional application No. 60/757,643, filed on Jan. 10, 2006.

(51) Int. Cl.
*H01B 7/00* (2006.01)

(52) U.S. Cl. ..... 174/135; 174/60; 439/719; 439/404

(58) Field of Classification Search ..... 174/135, 174/136, 59, 60, 19, 24; 439/719, 404, 405, 439/417; 385/134, 135, 136, 137, 139
See application file for complete search history.

(56) References Cited

U.S. PATENT DOCUMENTS

| | | | | |
|---|---|---|---|---|
| 3,459,878 | A * | 8/1969 | Gressitt et al. | 439/404 |
| 5,624,274 | A * | 4/1997 | Lin | 439/417 |
| 6,267,617 | B1 | 7/2001 | Nozick | |
| 6,302,699 | B1 * | 10/2001 | Conorich et al. | 439/719 |
| 6,315,596 | B1 * | 11/2001 | Chen | 439/417 |
| 6,488,525 | B2 | 12/2002 | Abel et al. | |
| 6,565,375 | B1 | 5/2003 | Daoud et al. | |

(Continued)

FOREIGN PATENT DOCUMENTS

CA 2 429 765 A1 11/2004

(Continued)

OTHER PUBLICATIONS

PCT International Search Report for PCT/US2006/045759 dated Apr. 4, 2007.

*Primary Examiner*—Angel R Estrada
(74) *Attorney, Agent, or Firm*—Myers Bigel Sibley & Sajovec

(57) ABSTRACT

A device for receiving and organizing twisted pairs of conductors from a cable having a plurality of twisted pairs of conductors includes a block with upper and lower surfaces, first and second opposing end walls that define a longitudinal axis, and first and second opposing side walls. The block further comprises at least one aperture extending from the upper surface toward the lower surface, the aperture being sized and configured to receive each of the plurality of twisted pairs of a cable. Each of the side walls includes at least one open-ended slot opening downwardly, each of the slots being sized and configured to receive a respective twisted pair of conductors. In this configuration, the device can facilitate termination of twisted pair conductors onto IDCs or the like and can provide a termination with less dimensional variation (and, in turn, less variation in electrical performance) than prior termination devices.

30 Claims, 9 Drawing Sheets

U.S. PATENT DOCUMENTS

| | | | | |
|---|---|---|---|---|
| 6,592,395 | B2 * | 7/2003 | Brown et al. | 439/405 |
| 6,592,396 | B2 | 7/2003 | Pepe et al. | |
| 6,746,283 | B2 * | 6/2004 | Arnett et al. | 439/404 |
| 6,752,647 | B1 | 6/2004 | Lin | |
| 6,767,241 | B1 | 7/2004 | Abel et al. | |
| 6,830,488 | B2 * | 12/2004 | Bush et al. | 439/719 |
| 6,953,362 | B2 | 10/2005 | Mössner et al. | |
| 7,025,621 | B2 | 4/2006 | Mössner et al. | |

FOREIGN PATENT DOCUMENTS

| | | |
|---|---|---|
| EP | 0 899 827 A2 | 3/1999 |
| EP | 0 982 815 A2 | 3/2000 |

* cited by examiner

DEVICE FOR MANAGING TERMINATION OF CONDUCTORS WITH JACK MODULES

RELATED APPLICATION

This application claims priority from U.S. Provisional Patent Application Ser. No. 60/757,643, filed Jan. 10, 2006 and entitled TERMINATION MANAGER, the disclosure of which is hereby incorporated herein in its entirety.

FIELD OF THE INVENTION

The present invention generally relates to routing twisted conductor pairs of a cable to a jack module and, in particular, to devices, systems and methods for controlling the consistency with which the twisted conductor pairs are routed.

BACKGROUND OF THE INVENTION

As is known, communications patch panels frequently incorporate the use of jack modules, like that shown at 100 in FIG. 1, that can be readily attached to and removed from the patch panel. Typically, existing jack modules 100 include a housing 102 having a front portion 104 and a back portion 110. The front portion 104 is visible to the user of the patch panel and includes one or more jack openings 106 configured to receive a communication connector (not shown). The front and back portions 104, 110 engage and mate with each other and serve to protect internal components, such as a printed wiring board 130, one or more jack receptacles 136, and/or a plurality of insulation displacement connectors (IDCs) 138. The jack receptacles 136 are mounted to the front side 132 of the printed wiring board 130, while the IDCs 138 are mounted to the back side 134. Traces (not shown) on the printed wiring board 130 electrically connect the IDCs 138 to electrical contacts 137 (see FIG. 2) housed within the jack receptacles 136. As assembled, each jack receptacle 136 aligns with a jack opening 106 in the front portion 104 of the housing 102, and the IDCs 138 are aligned with a terminal connection region 112 disposed on the back portion 110. As shown, the front portion 104 and the back portion 110 of the housing are secured together with assembly tabs 108 on the front portion 104 that engage assembly notches 109 on the back portion 110.

FIG. 2 illustrates the jack module 100 as it would be seen by a user of a typical communications patch panel. FIGS. 3 and 4 show the terminal connection region 112 in greater detail. As shown in FIG. 4, the terminal connection region 112 includes two substantially parallel rows 114 of alternating wire guide posts 116 and wire guide splitters 117. As best seen in FIG. 3, adjacent wire guide posts 116 and wire guide splitters 117 have a terminal slot 118 disposed therebetween. Each terminal slot 118 provides access to one of the IDCs 138 disposed within the parallel rows 114. Physical and electrical contact is made between a conductor (not shown) and an IDC 138 by urging the conductor into the terminal slot 118 until the conductor passes between the opposed prongs 139 of the IDC (FIG. 1). Opposed portions of the prongs 139 cut through insulation disposed around the conductor, thereby making electrical contact.

To electrically connect a cable including a plurality of twisted pairs to an existing jack module 100, first a technician determines which IDCs 138 are associated with the desired jack receptacle 136 (see FIG. 4). In FIG. 4, the IDCs 138 of interest are accessed by way of the pairs of terminal slots labeled 118*a*, 118*b*, 118*c*, and 118*d*, each of the pairs of the terminal slots 118 being configured to receive the conductors from one of the cable's twisted conductor pairs. Once the desired IDCs 138 have been determined, the technician urges the desired conductor into the appropriate IDC, typically using a device such as a punch-down tool. As shown, one twisted pair would be inserted into each pair of terminal slots 118*a*-118*d*. The wire guide splitters 117 assist the technician in separating the conductors of each twisted conductor pair, thereby making it easier for the technician to insert the desired conductor into the desired IDC 138.

Until recently, such methods of routing twisted pairs on the back of existing jack modules 100 were adequate for existing performance levels. This was because in the past variation of the routing of twisted pairs, from pair to pair, had little effect, if any, on performance. However, recent developments, such as patch panels requiring category 6 performance levels, are much more sensitive to variations in twisted pair termination and routing. One approach to reducing variation in termination and routing is illustrated in U.S. Pat. No. 6,767,241 to Abel et al., the disclosure of which is hereby incorporated herein in its entirety. This patent discusses a termination cap that receives the conductors from the cable, then routes them through apertures and slots in the cap in an organized fashion. The cap is attached to the back portion of the jack module, at which time the organized conductors can be routed to their respective IDCs. Nevertheless, it may in some instances be desirable to provide even more control of the positions of the conductors in order to further reduce variation in their seating with the IDCs, which in turn can improve electrical performance and reliability.

SUMMARY OF THE INVENTION

As a first aspect, embodiments of the present invention are directed to a device for receiving and organizing twisted pairs of conductors from a cable having a plurality of twisted pairs of conductors. The device comprises a block with upper and lower surfaces, first and second opposing end walls that define a longitudinal axis, and first and second opposing side walls. The block further comprises at least one aperture extending from the upper surface toward the lower surface, the aperture being sized and configured to receive each of the plurality of twisted pairs of a cable. Each of the side walls includes at least one open-ended slot opening downwardly, each of the slots being sized and configured to receive a respective twisted pair of conductors. In this configuration, the device can facilitate termination of twisted pair conductors onto IDCs or the like and can provide a termination with less dimensional variation (and, in turn, less variation in electrical performance) than prior termination devices.

As a second aspect, embodiments of the present invention are directed to a communication connection system comprising: a jack module with a plurality of IDCs, each of the IDCs having a slot for receiving therein a conductor; a communications cable comprising a plurality of twisted pairs of conductors; and a device for organizing the twisted pairs of conductors. The device comprises a block with upper and lower surfaces, first and second opposing end walls that define a longitudinal axis, and first and second opposing side walls. The block further comprises at least one aperture extending from the upper surface toward the lower surface, the aperture receiving each of the plurality of twisted pairs of the cable. Each of the side walls includes at least one open-ended slot opening downwardly, each of the slots sized and configured to receive a respective one of the twisted pair of conductors. The device is attached to the jack module, and each of the conductors is received in a respective one of the IDC slots.

As a third aspect, embodiments of the present invention are directed to a method of interconnecting a communications cable having a plurality of twisted pairs of conductors with a jack module. The method comprising the steps of: (a) providing a cable organizing device, the device including upper and lower surfaces, first and second opposing end walls that define a longitudinal axis, and first and second opposing side walls, the block further comprising at least one aperture extending from the upper surface toward the lower surface, and each of the side walls including at least one open-ended slot opening downwardly; (b) inserting the plurality of twisted pairs into the at least one aperture from above; and (c) securing each of the twisted pairs in a respective slot.

DETAILED DESCRIPTION OF EMBODIMENTS OF THE INVENTION

Figure 1:
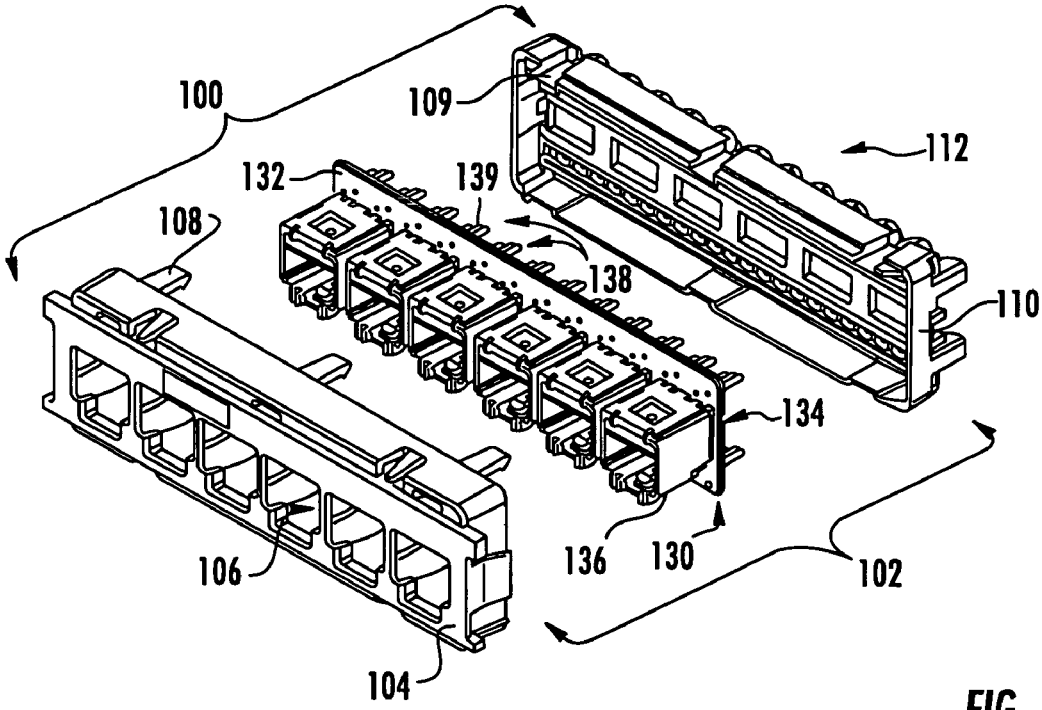
FIG. 1 (PRIOR ART)
FIG. 1 is an exploded, perspective view of a prior art jack module.
Figure 2:
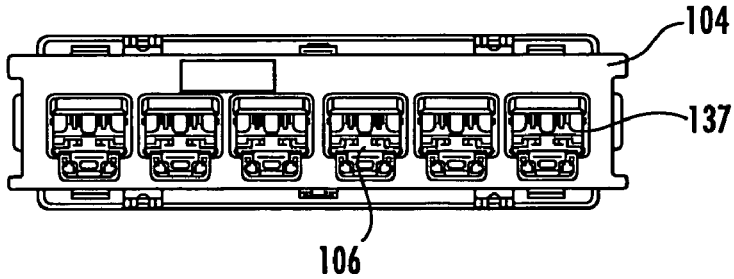
FIG. 2 (PRIOR ART)
FIG. 2 is a front elevational view of the jack module as shown in FIG. 1.
Figure 3:
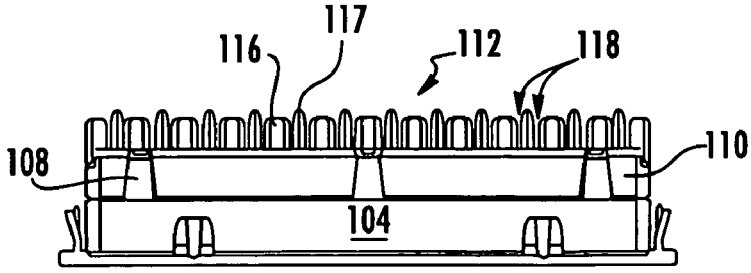
FIG. 3 (PRIOR ART)
FIG. 3 is a top view of the jack module as shown in FIG. 1
Figure 4:
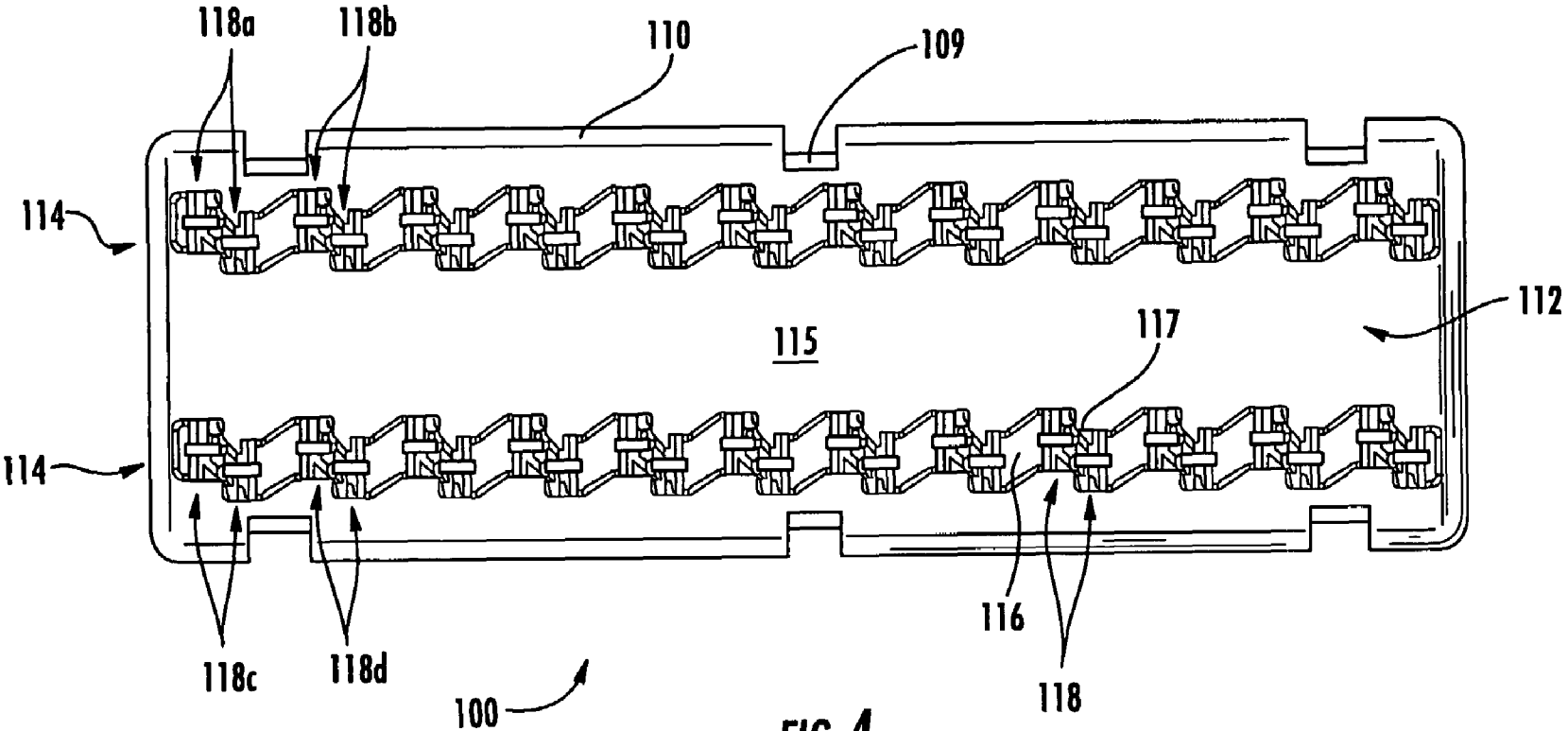
FIG. 4 (PRIOR ART)
FIG. 4 is a back view of the jack module as shown in FIG. 1.

The present invention will be described more particularly hereinafter with reference to the accompanying drawings. The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Where used, the terms "attached", "connected", "interconnected", "contacting", "mounted" and the like can mean either direct or indirect attachment or contact between elements, unless stated otherwise. Where used, the terms "coupled," "induced" and the like can mean non-conductive interaction, either direct or indirect, between elements or between different sections of the same element, unless stated otherwise.

Figure 5:
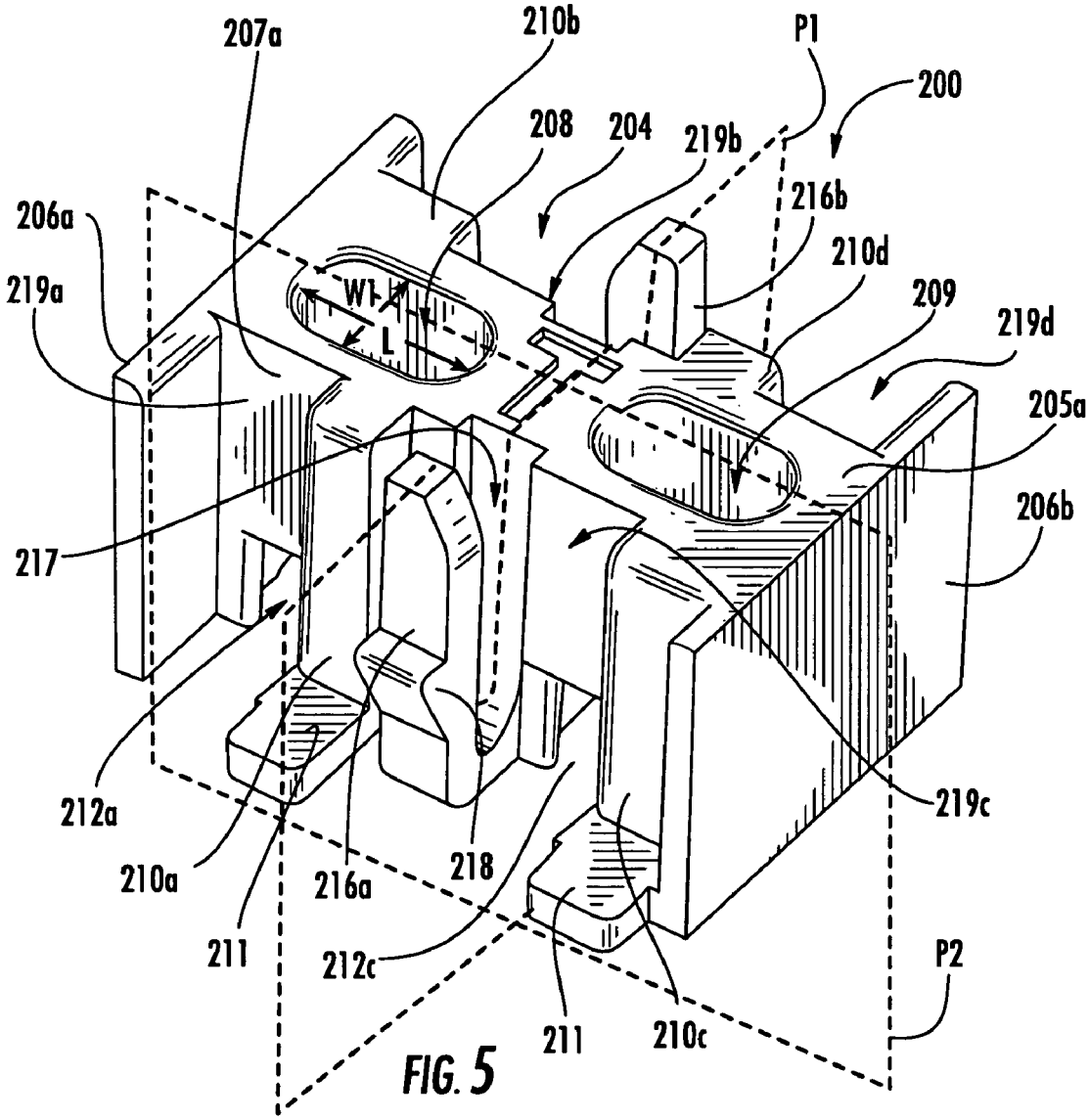
FIG. 5 is a top, front perspective view of a conductor termination device according to embodiments of the present invention.
Figure 6:
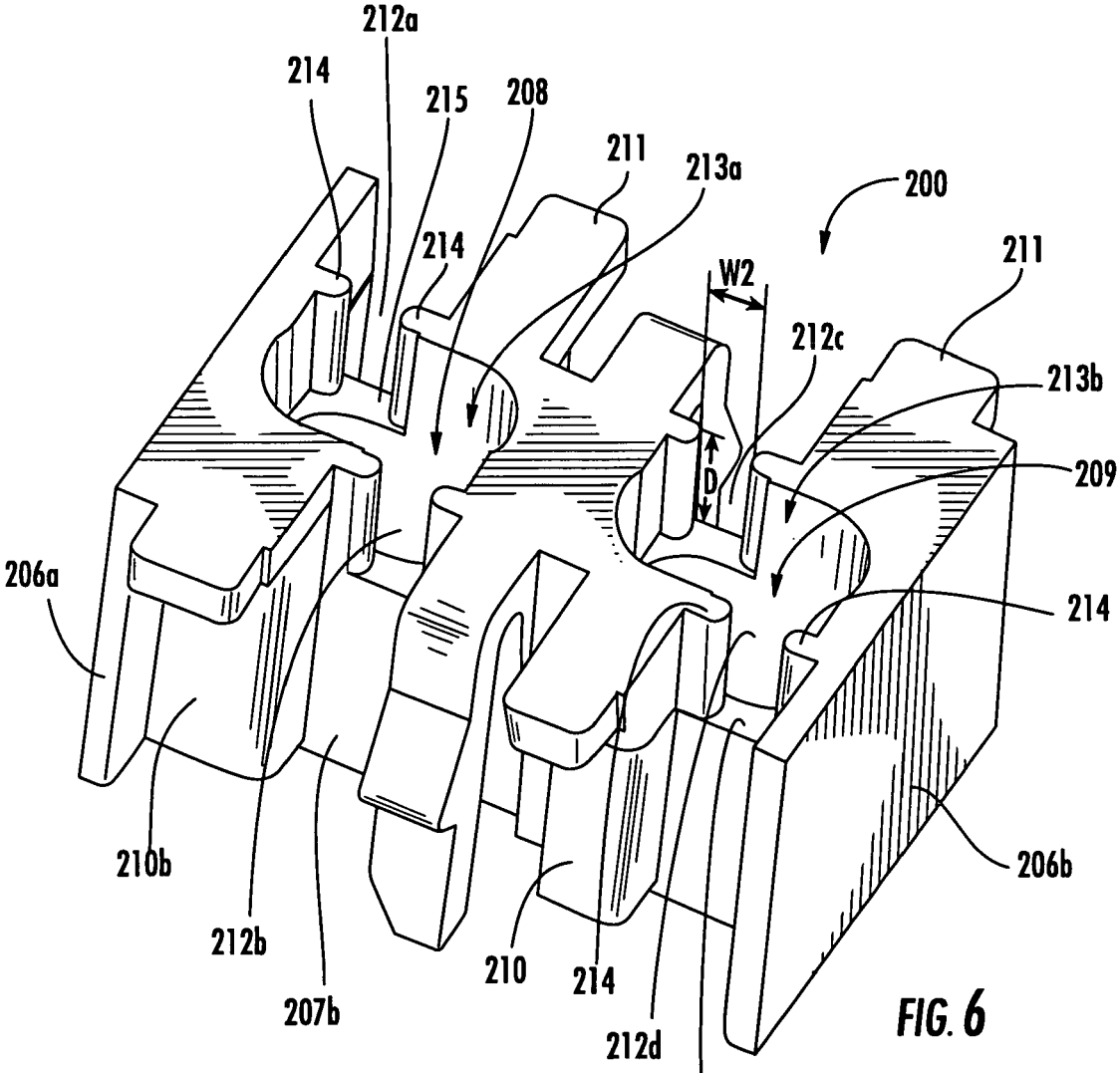
FIG. 6 is a bottom, rear perspective view of the device of FIG. 5.
Figure 6A:
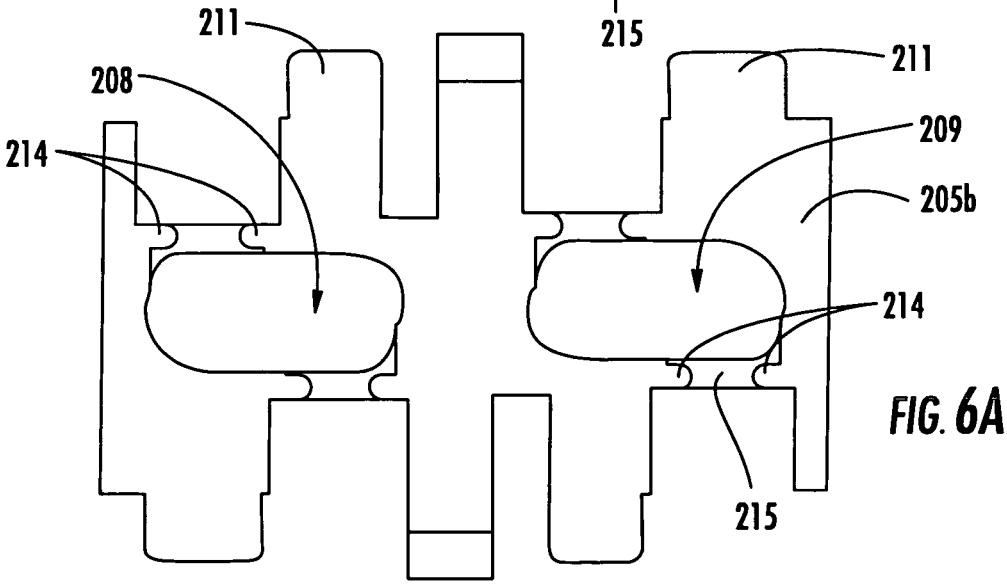
FIG. 6A is a bottom view of the device of FIG. 5.

Referring now to the figures, a conductor termination device, designated broadly at 200, is illustrated in FIGS. 5 and 6. The device 200 can assist in the attachment of cable conductors to a jack module, such as that designated at 100 above, by receiving and organizing the conductors prior to their interconnection with the jack module 100. The device 200 is described in greater detail below.

Referring again to FIGS. 5 and 6, the device 200 includes a block 204 with upper and lower surfaces 205*a*, 205*b*, end panels 206*a*, 206*b* attached at either end, and side walls 207*a*, 207*b* on opposite sides thereof. In this embodiment, the device 200 is configured such that, when divided by a plane P1 that bisects the block 204 and is generally parallel to the end panels 206*a*, 206*b*, the subdivisions are reverse mirror images of one another. Similarly, when the device 200 is divided by a plane P2 that is normal to both the end panels 206*a*, 206*b* and the plane P1, the resulting subdivisions are reverse mirror images of one another. This dual reverse mirror image configuration enables the device 200 to be employed in two different orientations relative to a mating jack module, thereby simplifying insertion.

In describing the relative positions of features of the device 200, the terms "inward," "outward," and derivatives thereof refer to the relative positions of structures along a transverse horizontal axis defined by plane P1. The terms "medial," "distal" and derivatives thereof refer to the relative positions of structures along a longitudinal horizontal axis defined by the plane P2. "Upward" is the direction toward the top of the page in FIG. 5, and "downward" is the direction toward the bottom of the page in FIG. 5.

Referring again to FIGS. 5 and 6, the block 204 includes two apertures 208, 209 that pass from the upper surface of the block 204 downwardly. Each of the apertures 208, 209 is illustratively oblong in shape, and the apertures 208, 209 are substantially aligned along the plane P2, although this shape and arrangement may vary in other embodiments. The apertures 208, 209 are each sized to receive two twisted conductor pairs from a cable. Typically the apertures 208, 209 have a length L between about 0.15 and 0.20 inches and a width W1 between about 0.09 and 0.13 inches. The side walls 207*a*, 207*b* include outwardly-extending projections 210*a*, 210*b*, 210*c*, 210*d*, with projections 210*a*, 210*d* being on opposite sides of the plane P2 and relatively near the plane P1, and projections 210*b*, 210*c* being on opposite sides from, respectively, the projections 210*a*, 210*d* and merging with the medial surfaces of the end panels 206*a*, 206*b*. A foot 211 extends outward from each of the projections 210*a*-210*d*.

Referring in particular to FIG. 6, open-ended slots 212*a*, 212*b* are in communication with the aperture 208 via an atrium 213*a* and are located on opposite sides of the block 204, and open-ended slots 212*c*, 212*d* are in communication with the aperture 209 via an atrium 213*b* and are located on opposite sides of the block 204. Each slot 212*a*-212*d* is framed on its sides by framing ribs 214 and on top by a ceiling 215. The width W2 of each slot 212*a*-212*d* may be selected such that a twisted area of a twisted pair of conductors fits snugly therein; a typical width W2 may be between about 0.035 and 0.05 inches. A typical depth D of the slots 212*a*-212*d* may be between about 0.09 and 0.13 inches.

Referring again to FIG. 5, two snap latches 216*a*, 216*b* are mounted to lower portions of the block 204 on opposite side thereof and extend upwardly. Each snap latch 216*a*, 216*b* has a hook 218 located below its free end. Inwardly of the latches 216*a*, 216*b* are recesses 217 in the side walls 207*a*, 207*b*, which can facilitate inward deflection of the latches 216*a*, 216*b*.

It can be seen in FIGS. 5 and 6 that four alcoves 219*a*, 219*b*, 219*c*, 219*d* are defined by structures of the block 204. More specifically, alcove 219*b* is bounded by the side wall 207*b*, one of the distal surfaces of the latch 216*b*, and the medial surface of the projection 210*b*. Similarly, alcove 219*c* is bounded by the side wall 207*a*, one of the distal surfaces of the latch 216*a*, and the medial surface of the projection 210*c*. Alcove 219*a* is bounded by the side wall 207*a*, the distal surface of the projection 210*a*, and the medial surface of the end panel 206*a*. Similarly, alcove 219*d* is bounded by the side wall 207*b*, the distal surface of the projection 210*d*, and the medial surface of the end panel 206*b*. Each of the alcoves 219*a*-219*d* is in communication with and is generally parallel to its respective slot 212*a*-212*d*.

In the illustrated embodiment, the device is formed as a unitary member. In some embodiments, the device is formed of a polymeric material, such as polycarbonate or ABS.

Figure 7:
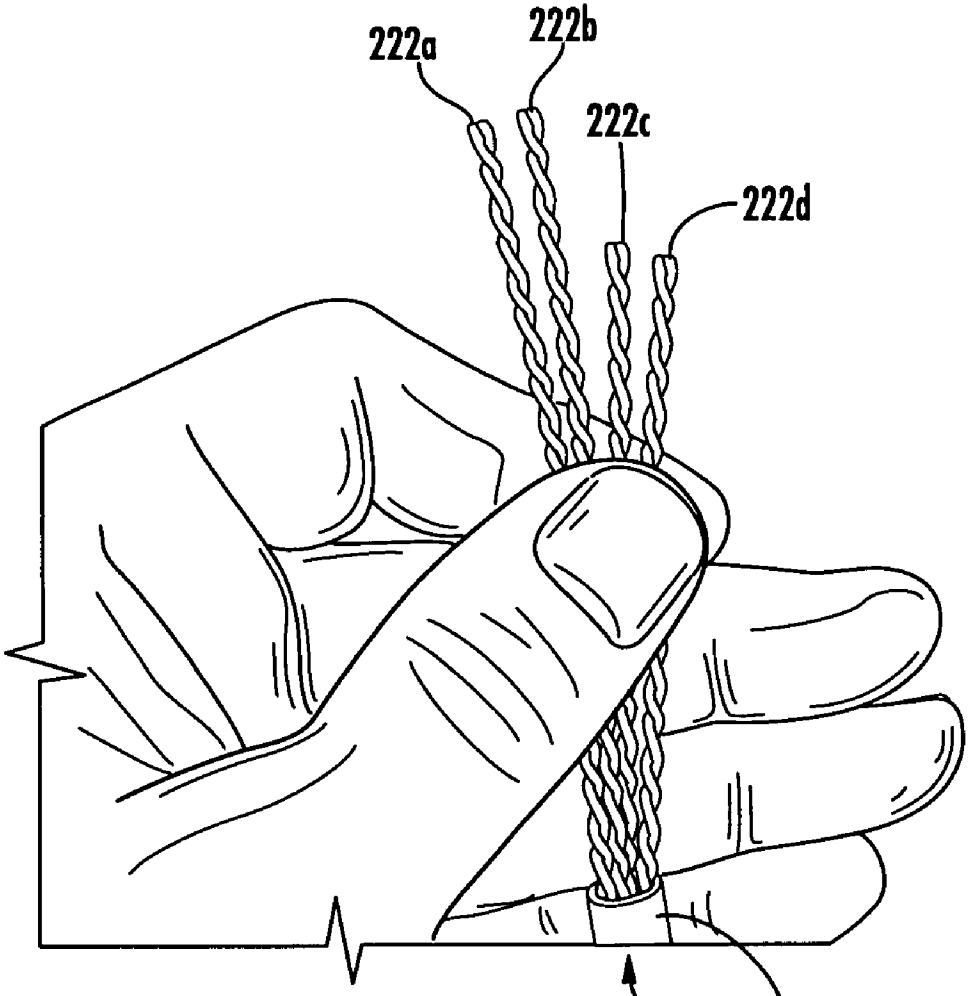
FIG. 7 is a front view of a cable with four twisted pairs of conductors prior to insertion into a conductor termination device.
Figure 10:
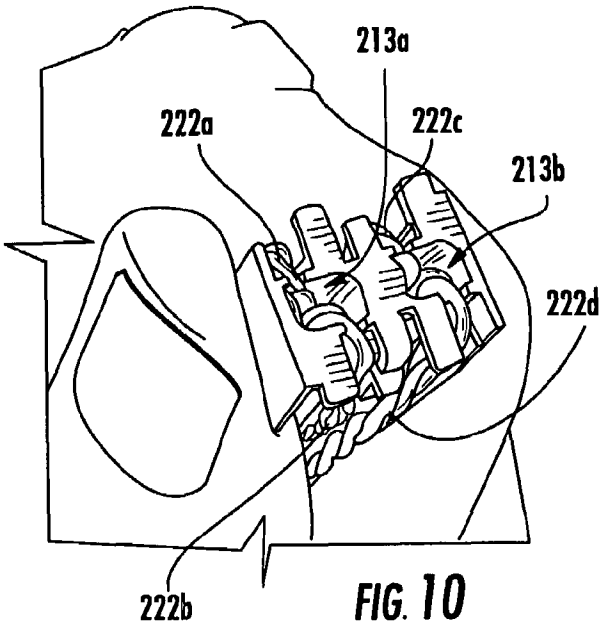
FIG. 10 is a top, front, perspective view of conductors being folded into the slots of the device of FIG. 5 such that the free ends of the conductors are generally parallel with the cable.

Use of the device 200 to terminate the conductors of a cable can be understood with reference to FIGS. 7-12. An exemplary cable 220 having four twisted conductor pairs 222*a*, 222*b*, 222*c*, 222*d* sheathed by a jacket 221 is shown in FIG. 7. To initiate the termination process, the jacket 221 is trimmed, and any divider between the twisted pairs 222*a*-222*d* (not shown herein) is removed. The twisted pairs 222*a*-222*d* are then oriented in a relatively flat, side-by-side arrangement as shown in FIG. 7. Sequences for the twisted pairs according to T568A and T568B wiring protocols are listed below in Table 1.

TABLE 1

| | | | | |
|---|---|---|---|---|
| "A" Wiring Scheme | Blue | Brown | Orange | Green |
| "B" Wiring Scheme | Blue | Brown | Green | Orange |

In some instances, the conductors (in particular the orange and green pairs) may be trimmed to facilitate insertion.

Figure 8:
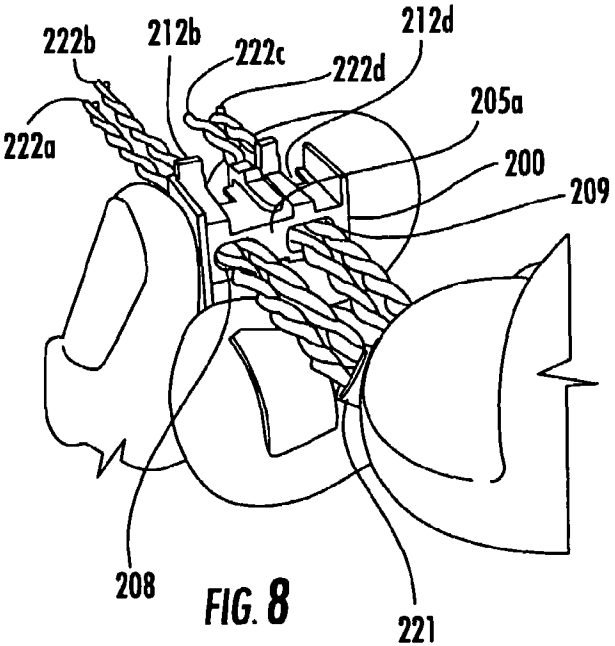
FIG. 8 is a front view of the conductors of the cable of FIG. 7 being inserted into the termination device of FIG. 5.

Referring now to FIG. 8, the twisted pairs 222*a*-222*d*, still in the flat arrangement described above, are inserted into the apertures 208, 209 of the device 200 (note that in FIG. 8, the device 200 is inverted from its orientation in FIG. 5), such that the conductors of the twisted pairs 222*a*-222*d* emerge from the lower surface 205*b* of the device 200 after passing through the atria 213*a*, 213*b*. Because the apertures 208, 209 are oblong, they can receive the twisted pairs 222*a*-222*d*, with each aperture 208, 209 receiving two twisted pairs, and maintain the desired side-by-side relationship of twisted pairs arranged prior to insertion. The device 200 is fed onto the twisted pairs 222*a*-222*d* until it meets resistance from the jacket 221.

Figure 9:
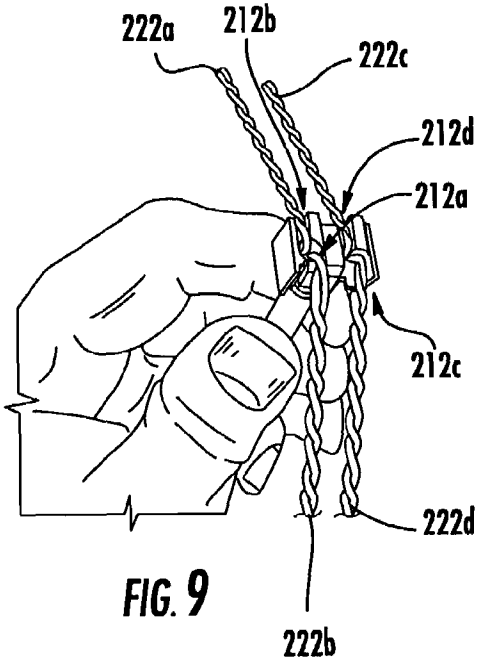
FIG. 9 is a top, front, perspective view of conductors being folded into the slots of the device of FIG. 5.

As can be seen in FIG. 9, each of the twisted pairs 222*a*-222*d* is folded generally perpendicularly into its adjacent slot 212*a*-212*d*. In some embodiments, the slots 212*a*-212*d* are sized to be slightly larger than the diameter of one of the conductors, such that an intersection or crossing point of each twisted pair resides in the slots 212*a*-212*d*. As such, the conductors in each twisted pair are vertically stacked within the slot. In some embodiments, it may be desirable to position the wires in the manner described in Table 2 (the terms "top" and "bottom" in Table 2 are with reference to FIG. 9).

TABLE 2

| | | | | |
|---|---|---|---|---|
| "A" Wiring Scheme | Blue Wire on Top | Brown Wire on Bottom | Orange Wire on Bottom | Green Wire on Top |
| "B" Wiring Scheme | Blue Wire on Top | Brown Wire on Bottom | Green Wire on Bottom | Orange Wire on Top |

Folding of the twisted pairs 222*a*-222*d* in the slots 212*a*-212*d* can continue, with the twisted pairs 222*a*-222*d* being folded into their respective alcoves 219*a*-219*d* until the twisted pairs 222*a*-222*d* are generally parallel with the cable 220 (FIG. 10), at which point all of the twisted pairs 222*a*-222*d* and the cable 220 can be grasped in one hand.

Figure 12:
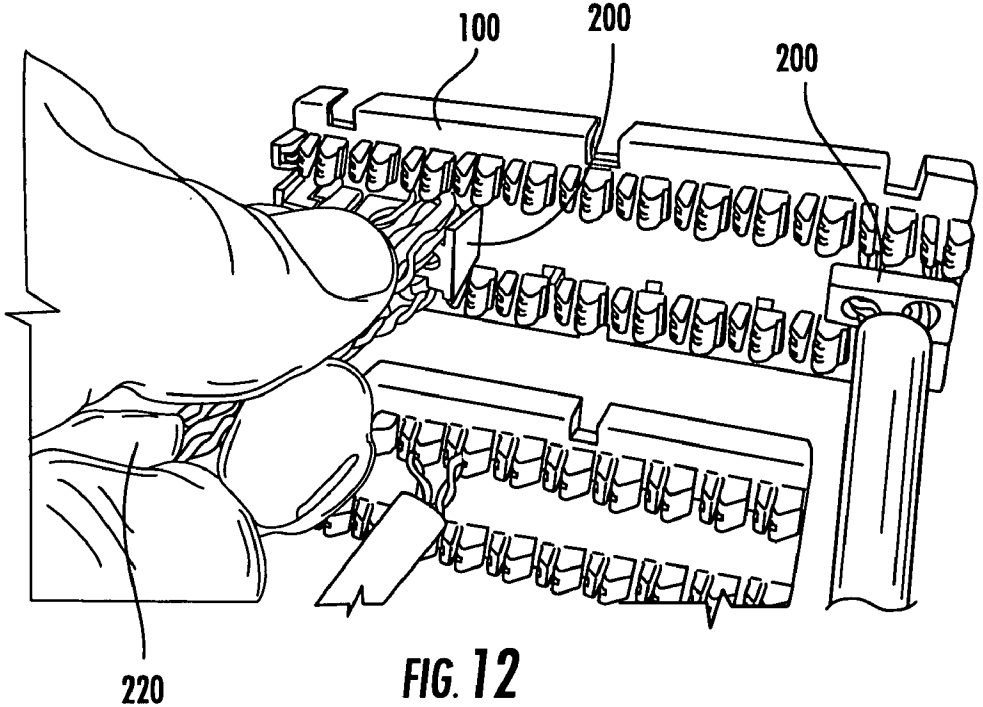
FIG. 12 is a front, top, perspective view of the cable and device of FIG. 9 being inserted into a jack module.
Figure 11:
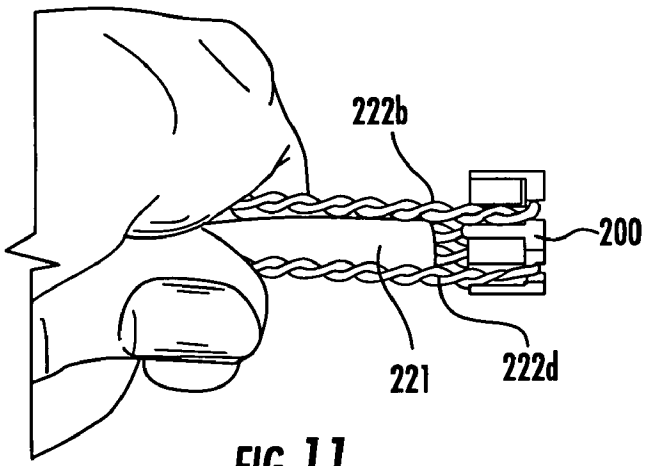
FIG. 11 is a side view of the cable and device of FIG. 10.

Referring now to FIG. 12, the operator grasps the cable 220 and the twisted pairs 222*a*-222*d* in one hand and presses the device 200 into a desired location on the jack module 100. In some embodiments, the jack module includes a label or other indicia that indicate the proper orientation and alignment of the device 200. During this action, the latches 216*a*, 216*b* are received in slots or other engagement structure in the jack module 100. The presence of the hooks 218 forces the latches 216*a*, 216*b* to deflect into their respective recesses 217, then to recover as the hooks clear a mating structure in the jack module. Engagement of the hooks secures the device 200 into place on the jack module 100.

Figure 13:
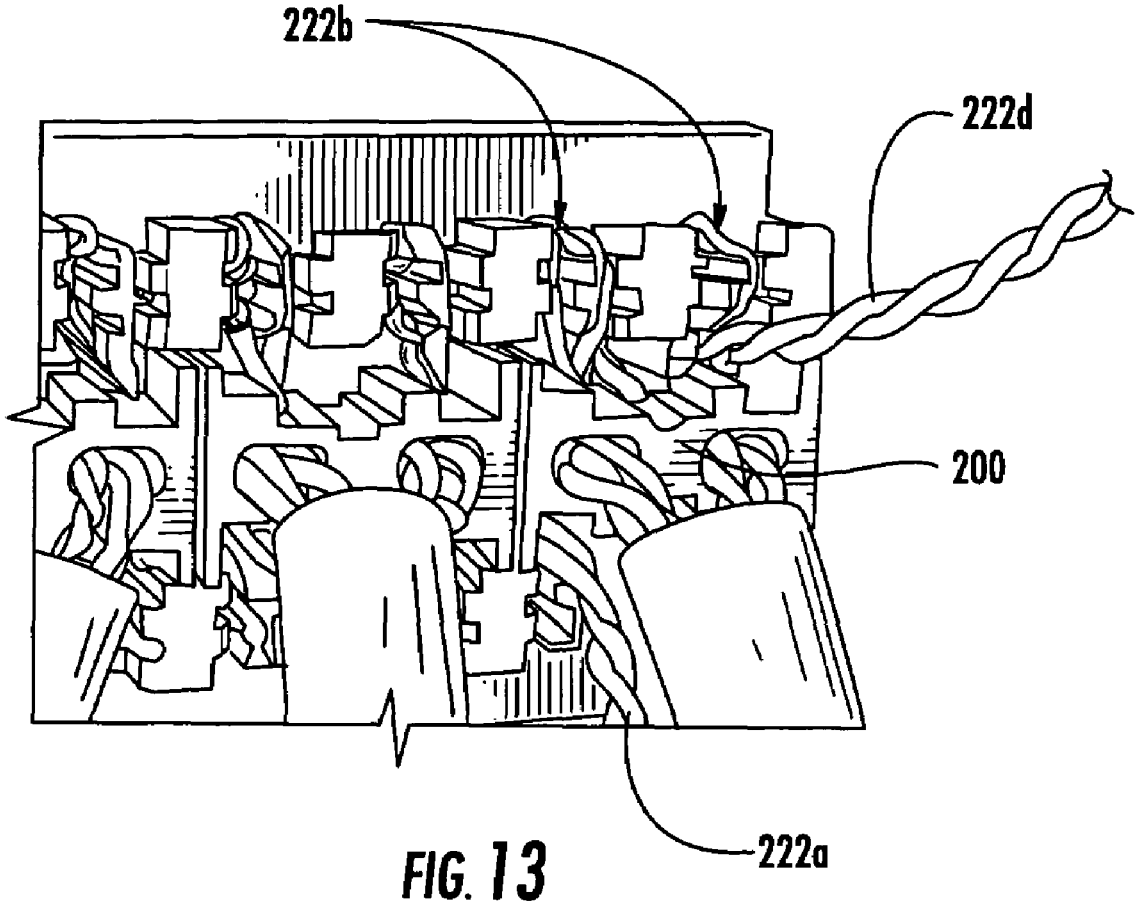
FIG. 13 is a front, top, perspective view of the cable, device and jack module of FIG. 12 showing the insertion of individual conductors into IDC slots in the jack module.
Figure 14:
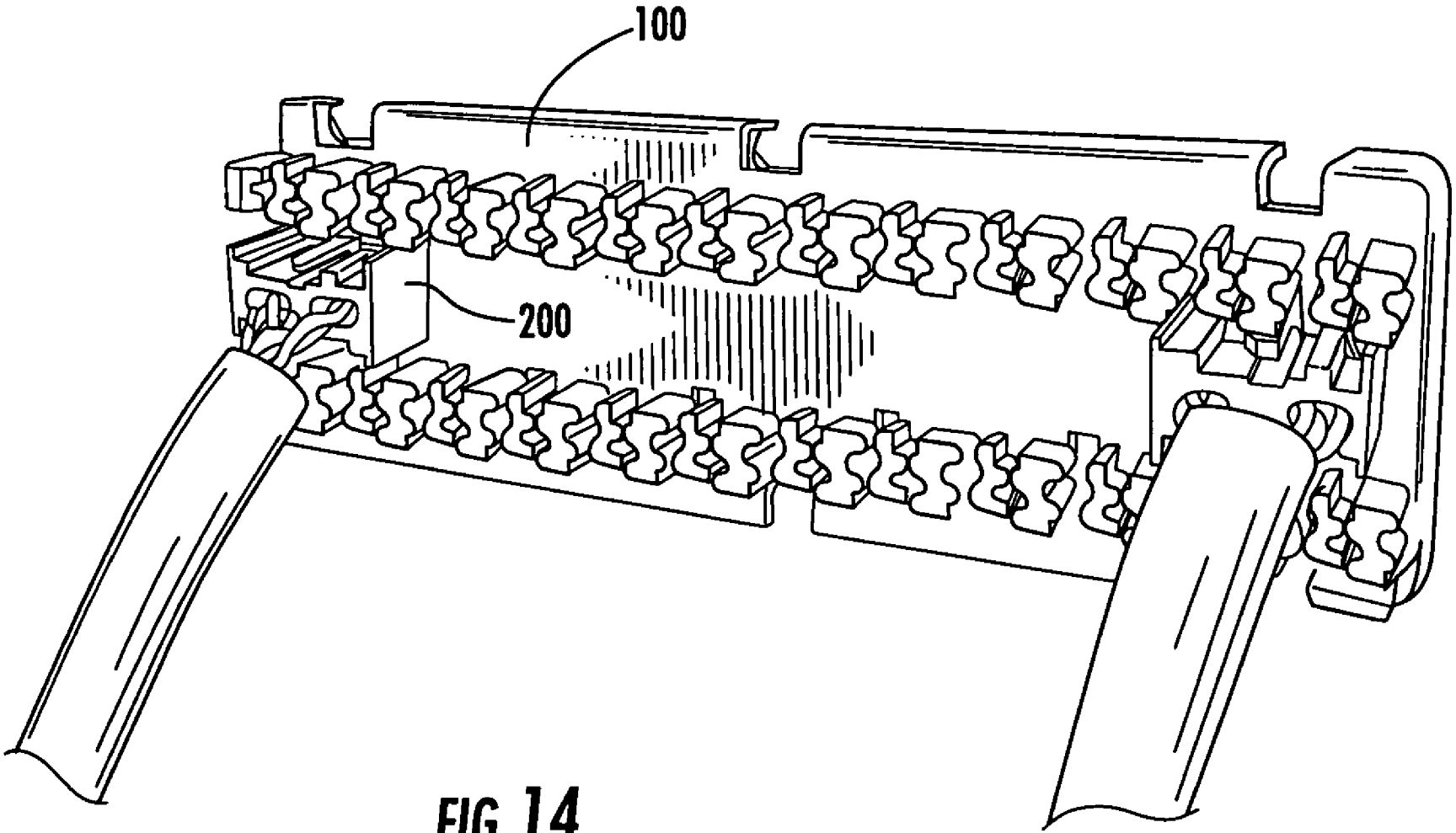
FIG. 14 is a front, top, perspective view of the cable and conductors installed in the jack module with the conductor termination device of FIG. 5.

After the device 200 is snapped into place, the conductors of the twisted pairs 222*a*-222*d* can be untwisted and aligned with individual terminal slots in the jack module 100 (see FIG. 13). The conductors can then be engaged with the terminal slots (thereby electrically connecting the conductors with the jack module 100) with a conventional punch-down tool.

The device 200 can provide multiple performance advantages. First, the "reverse mirror image" configuration of the device 200 can enable the device to be employed in two different orientations, which can facilitate use. Second, when the conductors are seated in the slots 212*a*-212*d* such that they pass through the slot at a twist intersection, the variability of conductor length, orientation and twist can be reduced between different installations, thereby improving electrical performance. Third, engagement of the conductors in the slots can provide strain relief to the conductors. Finally, the device 200, via release of the latches 216*a*, 216*b*, can be removed from the jack module 100 after insertion but prior to punch-down should such removal be desirable.

Those skilled in this art will appreciate that other configurations for the device 200 may also be suitable. For example, the apertures 208, 209 may be combined into a single aperture, or the device may include an aperture for each twisted pair. The device may be configured to receive more or fewer than for twisted pairs of conductors. The alcoves 219*a*-219*d* may be omitted, or may be defined by different structures of the device. The latches 216*a*, 216*b* may be configured differently or omitted. Other configurations may be recognizable to those skilled in this art.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A device for receiving and organizing twisted pairs of conductors from a cable having a plurality of twisted pairs of conductors, the device comprising:

a block with upper and lower surfaces, first and second opposing end walls that define a longitudinal axis, and first and second opposing side walls, the block further comprising at least one aperture extending from the upper surface toward the lower surface, the aperture being sized and configured to receive each of the plurality of twisted pairs of a cable, each of the side walls including at least one open-ended slot opening downwardly, each of the slots sized and configured to receive a respective twisted pair of conductors.

2. The device defined in claim 1, wherein the at least one aperture is two apertures, and wherein each of the apertures is sized and configured to receive two twisted pairs of a cable.

3. The device defined in claim 2, wherein each of the apertures is oblong and sized such that twisted pairs are received therein in side-by-side relationship.

4. The device defined in claim 3, wherein the apertures are substantially aligned.

5. The device defined in claim 2, wherein each of the apertures is between about 0.15 and 0.20 inches in length between about 0.09 and 0.13 inches in width.

6. The device defined in claim 1, wherein the block includes an alcove in each side wall corresponding to each slot.

7. The device defined in claim 6, wherein each alcove is generally parallel with each slot.

8. The device defined in claim 1, wherein each of the side walls includes two open-ended slots.

9. The device defined in claim 1, wherein each slot is longitudinally offset from the slot on the opposite side wall.

10. The device defined in claim 1, wherein each of the slots is between about 0.035 and 0.05 inches in width and between about 0.09 and 0.13 inches in depth.

11. The device defined in claim 1, wherein a receiving atrium is present below the at least one aperture.

12. The device defined in claim 1, further comprising a latch mounted to and extending laterally from each of the first and second sidewalls.

13. A communication connection system, comprising:

a jack module with a plurality of insulation displacement connectors (IDCs), each of the IDCs having a slot for receiving therein a conductor;

a communications cable comprising a plurality of twisted pairs of conductors; and a device for organizing the twisted pairs of conductors, the device comprising a block with upper and lower surfaces, first and second opposing end walls that define a longitudinal axis, and first and second opposing side walls, the block further comprising at least one aperture extending from the upper surface toward the lower surface, the aperture receiving each of the plurality of twisted pairs of the cable, each of the side walls including at least one open-ended slot opening downwardly, each of the slots sized and configured to receive a respective one of the twisted pair of conductors;

wherein the device is attached to the jack module, and wherein each of the conductors is received in a respective one of the IDC slots.

14. The communication connection system defined in claim 13, wherein the at least one aperture is two apertures, and wherein each of the apertures is sized and configured to receive two twisted pairs of the cable.

15. The communication connection system defined in claim 14, wherein each of the apertures is oblong and sized such that twisted pairs are received therein in side-by-side relationship.

16. The communication connection system defined in claim 15, wherein the apertures are substantially aligned.

17. The communication connection system defined in claim 14, wherein each of the apertures is between about 0.15 and 0.20 inches in length between about 0.09 and 0.13 inches in width.

18. The communication connection system defined in claim 13, wherein the block includes an alcove in each side wall corresponding to each slot.

19. The communication connection system defined in claim 18, wherein each alcove is generally parallel with each slot.

20. The communication connection system defined in claim 13, wherein each of the side walls includes two open-ended slots.

21. The communication connection system defined in claim 13, wherein each slot is longitudinally offset from the slot on the opposite side wall.

22. The communication connection system defined in claim 13, wherein each of the slots is between about 0.035 and 0.05 inches in width and between about 0.09 and 0.13 inches in depth.

23. The communication connection system defined in claim 13, wherein a receiving atrium is present below the at least one aperture.

24. The communication connection system defined in claim 13, further comprising a latch mounted to and extending laterally from each of the first and second sidewalls that engages the jack module.

25. A method of interconnecting a communications cable having a plurality of twisted pairs of conductors with a jack module, the method comprising the steps of:

providing a cable organizing device, the device including upper and lower surfaces, first and second opposing end walls that define a longitudinal axis, and first and second opposing side walls, the block further comprising at least one aperture extending from the upper surface toward the lower surface, and each of the side walls including at least one open-ended slot opening downwardly;

inserting the plurality of twisted pairs into the at least one aperture from above; and securing each of the twisted pairs in a respective slot.

26. The method defined in claim 25, further comprising the step of folding the twisted pairs after the securing step such that free end portions of the twisted pairs are generally parallel to the communications cable.

27. The method defined in claim 25, further comprising the step of attaching the device to the jack module.

28. The method defined in claim 27, further comprising the step of inserting individual conductors of each twisted pair into respective ports of the jack module.

29. The method defined in claim 27, wherein the step of attaching the device to the jack module comprises engaging a latch on the device with the jack module.

30. The method defined in claim 25, wherein the securing step comprises securing the twisted pairs in the slot at a twist intersection, such that one of the conductors of the pair is positioned above the other conductor of the pair.

* * * * *